US005501363A

United States Patent [19]

Muller et al.

[11] Patent Number: 5,501,363

[45] Date of Patent: Mar. 26, 1996

[54] COMBINATION DRINKING CUP AND MEGAPHONE

[76] Inventors: Robert E. Muller, 227 Key Palm Rd., Boca Raton, Fla. 33432; Robert Tinari, 150 NW. 7th Ct., Boca Raton, Fla. 33486; David J. Canestrale, Jr., 82 Vista Del Rio, Boynton Beach, Fla. 33426

[21] Appl. No.: 260,528

[22] Filed: Jun. 16, 1994

[51] Int. Cl.[6] ..... B65D 25/24

[52] U.S. Cl. ..... 220/630; 181/177; 220/709

[58] Field of Search ..... 248/346.1; 181/177; 84/93; 220/625, 628, 630, 636, 638, 709, DIG. 19, 288

[56] References Cited

U.S. PATENT DOCUMENTS

| | | | |
|---|---|---|---|
| D. 275,438 | 9/1984 | Everson . | |
| D. 283,772 | 5/1986 | Vail . | |
| D. 333,409 | 2/1993 | Dietzmann . | |
| 396,974 | 1/1889 | Barrath | 220/638 |
| 558,135 | 4/1896 | White | 220/628 |
| 2,686,625 | 8/1954 | Sundholm | 220/630 |
| 4,125,218 | 11/1978 | DeBoer . | |
| 4,618,066 | 10/1986 | Vail . | |
| 4,632,268 | 12/1986 | Melzi et al. | 220/288 |
| 4,941,635 | 7/1990 | Lan | 248/346.1 |
| 5,361,935 | 11/1994 | Sagucio | 220/709 |

*Primary Examiner*—Stephen J. Castellano
*Attorney, Agent, or Firm*—Harness, Dickey & Pierce

[57] ABSTRACT

The present invention relates to an apparatus which is easily convertible from a container such as a drinking cup, into a megaphone and thereafter back to a container. Ideally, the apparatus will include a team logo or other such representation of support thus making it especially suitable for use at sporting events and the like.

16 Claims, 1 Drawing Sheet

FIG. 1.
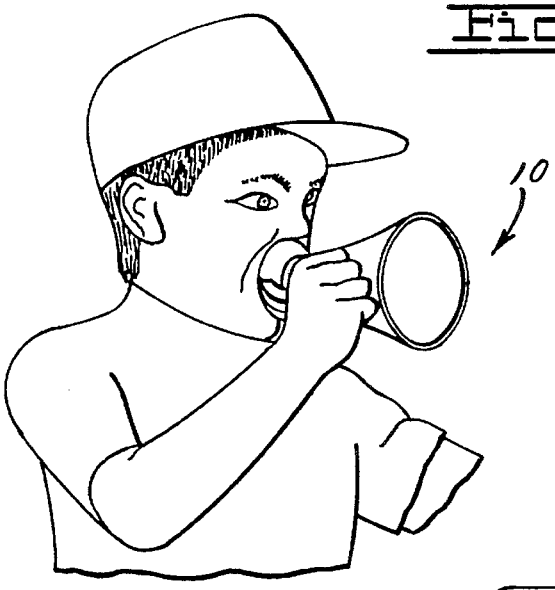
FIG. 2.
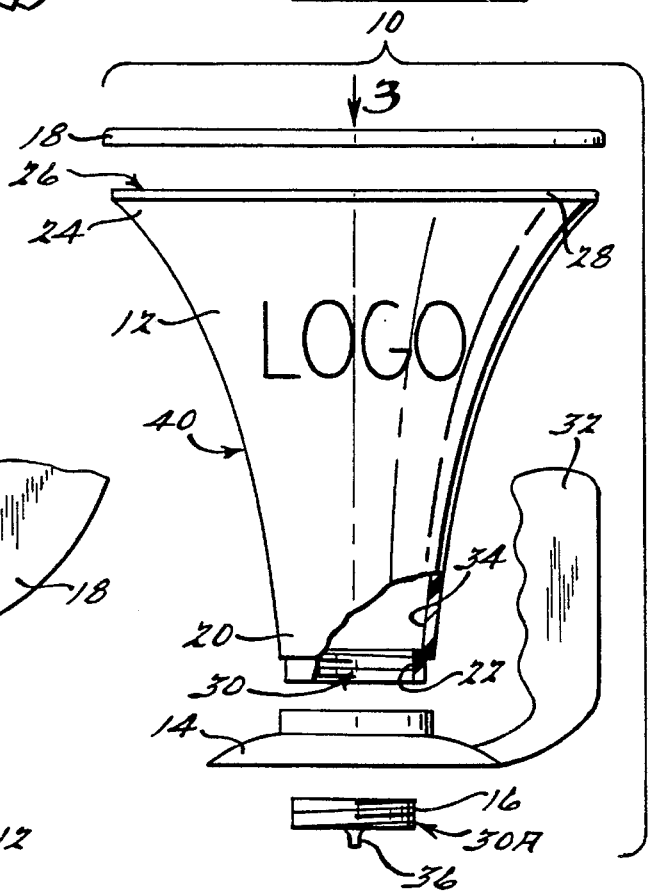
FIG. 3.
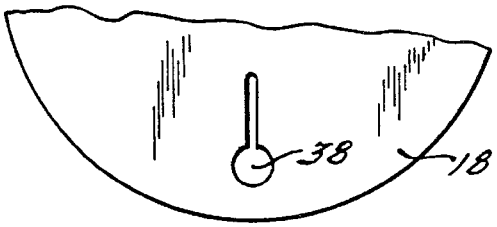
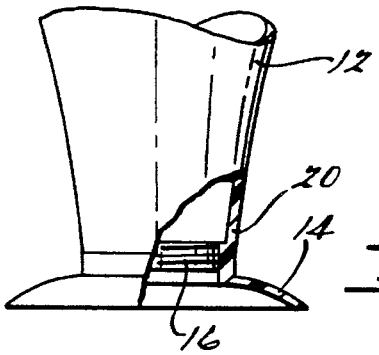
FIG. 4.

COMBINATION DRINKING CUP AND MEGAPHONE

BACKGROUND OF THE INVENTION

The present invention relates to a drinking cup assembly, and more particularly, to a drinking cup assembly which is convertible into either a megaphone or container such as a personal savings bank depending upon the user's needs.

Often at social engagements such as concerts, festivals and sporting events, among others, those in attendance are able to purchase memorabilia and souvenirs which typically include a display of the individual or group performing at the event, a team logo, or other symbols representative of the event. Of the souvenirs which are currently available most have very limited function and in fact may only serve to illustrate one's support for an organization with no other function. Thus, a device which could be utilized as both a symbol of support and serve other functions would be highly desirable.

The drinking cup assembly according to the teachings of the present invention fulfills this need. Not only does the assembly serve as a drinking cup, but it also can be converted into a megaphone for use in vocalizing one's support for a person, group, team or other organization. In addition, the drinking cup assembly can be utilized as a container (i.e. a savings bank or other such storage device) merely by applying the snap fit cap which comes as part of the assembly.

The objects and advantages of the present invention can be best understood by discussing the multifaceted aspects of the invention. By way of example, initially drinking cup assembly could be sold as a pre-assembled unit wherein the drinking cup includes as its main components a body portion, a selectively removable plug disposed along one end and a selectively removable cap disposed along the opposite end. The preassembled unit would be filled with food and/or drinks which are contained within the body of the device. If desired the cap is applied thereover to assist in maintaining the product within the device. Ideally, the outer surface of the body would include some illustration symbolizing the event or one's support for a particular organization. Thereafter, once the food product or beverage has been dispensed the drinking cup can be converted into a megaphone for enhanced vocalization of one's support by removing the cap and bottom plug portions. By drawing the narrow end of the body portion near one's mouth and speaking, yelling or otherwise vocalizing through the narrow end of the megaphone one can assert their support.

In addition to utilizing the assembly as either a drinking cup or a megaphone in the above described manner the device of the present invention may also used as a storage compartment such as a souvenir bank for receiving coins and the like after the plug and cap have been reapplied to the body portion. Ideally, the cap will include a slot or other aperture through which objects such as straws and coins can be inserted.

Accordingly, it is the primary object of the present invention to provide a multi-purpose apparatus useful either a drinking cup, a megaphone or a containment vessel for various items depending on the user's needs.

Another object of the present invention is to provide a multipurpose apparatus which is useful as memorabilia or as a souvenir capable of displaying a team logo or other such representation of one's support for an organization.

Yet another object of the present invention is to provide an easily convertible structure which is inexpensive to manufacture.

Additional objects and advantages of the present invention will become apparent from a reading of the detailed description of the preferred embodiments which makes reference to the following set of drawings in which:

DETAILED DESCRIPTION OF THE DRAWINGS

FIG. 1 is a perspective view of an individual utilizing the apparatus of the present invention as a megaphone;

FIG. 2 a blown out side assembly view of the apparatus useful as a drinking cup, megaphone or containment vessel according to the teachings of the present invention;

FIG. 3 is a partially broken away top perspective view of the detachable cap including a combination aperture and slot for receiving objects therethrough; and FIG. 4 is a partially broken away side view of an the apparatus illustrating the molded assembly according to the teachings of the present invention.

DETAILED DESCRIPTION OF THE PREFERRED EMBODIMENT

Referring to FIG. 2, a blown out side perspective view of the multipurpose apparatus 10 of the present invention is provided. As previously noted, the apparatus is convertible from a container for products such as refreshments including both liquids and solids, to a megaphone for amplification of one's voice as demonstrated in FIG. 1 and back to a container for any one of a number of objects.

The apparatus 10 typically includes four main components, namely, a hollow body portion 12, an integral coaster portion 14, a resealable plug 16 and a cap 18. The hollow body portion 12 which has a substantially conical shape includes a first end 20 having a port hole 22 and a second end 24 which includes an enlarged opening 26 which is defined by the circumference of the pouring lip 28. Preferably, the first end of the body portion located along the port hole includes threads as indicated by reference numeral 30 for receiving the plug 16 as will be described below.

The coaster portion 14 which preferably is integrally molded to the body portion 12 as illustrated more clearly in FIG. 4 is designed to support the weight of the apparatus when it is full. Ideally, the coaster 14 has a maximum diameter which is approximately twice that of the body portion's first end. The coaster has an inverted bowl shape and under at least one embodiment has a J-shaped handle 32 extending therefrom which is especially useful when the apparatus is being utilized as a megaphone as shown in FIG. 1.

The plug 16 is designed to fit snugly within the port hole 22 of the body portion's first end thus making it possible to utilize the apparatus as a container for objects such as liquid refreshments. Under a preferred embodiment the plug 16 includes radially outwardly extending threads 30A which mate with the threads 30 provide on the inner surface 34 of the body portion proximate to the port hole. Other means for connecting the plug to the body portion such as press fits and bayonet connections, among others can be utilized. To attach the plug to the body portion, the plug is inserted through the bottom of the hollow coaster and screwed into the port hole. For ease in screwing and unscrewing the plug 16 from the body portion 12, a finger tab 36 which extends downwardly from the plug is provided.

The press fit cap 18 of the apparatus 10 is designed to fit tightly over the pouring lip 28 of the body portion. Again, while a press fit relationship is illustrated as a preferred means of attachment, others are also available such as threaded and bayonet connections to name a few. Regardless of the way in which the cap is connected over the pouring lip along the second end of the body portion, ideally the cap will include a specialized aperture 38 such as that shown in FIG. 4 which allows for the limited ingress and egress of objects such as straws and coins.

Preferably, the apparatus 10 is formed using a conventional technique such as injection or blow molding from a durable, lightweight plastic material thus making the resulting product affordable as a promotional item. Due to the limited production costs the convertible apparatus of the present invention can be provided with a display such as a team logo and the like on the outer surface 40 to show one's support for a particular team.

While the above detailed description constitutes the preferred embodiments of the present invention, it will be appreciated that the invention is susceptible to modifications, variations and change without departing from the proper scope and fair meaning of the accompanying claims.

What is claimed is:

1. An apparatus useful as a multipurpose container under at least one adaptation and as a megaphone under another adaptation, the apparatus comprising:

a hollow body portion having a narrow first end, an enlarged second end and an integral substantially hollow coaster portion disposed along said first end for selectively maintaining the apparatus in an upright position, said first end including a port hole and said second end including an enlarged opening defined by a pouring lip;

a resealable, selectively detachable plug insertible through said coaster means for connection to said body portion along the first end to seal the port hole; and a selectively attachable cap which is press fit over said pouring lip to close off the enlarged opening occurring at said second end;

whereby upon detaching the plug and the selectively attachable cap from the body portion the apparatus can be converted from a multipurpose container to a megaphone.

2. The apparatus of claim 1, further comprising handle means extending from said body portion for grasping the apparatus.

3. The apparatus of claim 2 wherein said handle means extend from said coaster.

4. The apparatus of claim 3, wherein said handle means is substantially J-shaped.

5. The apparatus of claim 1, wherein said cap includes at least one aperture for permitting limited ingress and egress of objects into the container through said aperture.

6. The apparatus of claim 1, wherein the first end of said body portion and said plug include mating threads for selective attachment and removal of said plug.

7. The apparatus of claim 6, wherein said plug includes tab means extending from one end therefrom to assist in screwing and unscrewing the plug from said body portion.

8. The apparatus of claim 1, wherein said body portion is substantially conical which allows for enhanced voice amplification.

9. The apparatus of claim 1, wherein said coaster means has an inverted bowl shape.

10. An apparatus useful as a multipurpose container under at least one adaptation and as a megaphone under another adaptation, the apparatus comprising:

a substantially conical hollow body portion having a narrow first end, an enlarged second end and an integral substantially hollow coaster portion having an inverted bowl shape disposed along said first end for selectively maintaining the apparatus in an upright position, said first end including a port hole and said second end including an enlarged opening defined by a pouring lip;

a resealable, selectively detachable plug insertible through said coaster portion; and a press fit cap which is attachable over said pouring lip to close off the enlarged opening;

whereby the apparatus is capable of being converted into a megaphone by detaching said plug and removing said cap.

11. The apparatus of claim 10, further comprising handle means extending from said body portion for grasping the apparatus.

12. The apparatus of claim 11 wherein said handle means extend from said coaster.

13. The apparatus of claim 12, wherein said handle means is substantially J-shaped.

14. The apparatus of claim 10, wherein said cap includes at least one aperture for permitting the limited ingress and egress of objects into the container through said aperture.

15. The apparatus of claim 10, wherein the first end of said body portion and said plug include mating threads for selective attachment and removal of said plug.

16. The apparatus of claim 15, wherein said plug includes a tab member extending therefrom to assist in screwing and unscrewing the plug from said body portion.

* * * * *